US005501171A

United States Patent [19]

Leake

[11] Patent Number: 5,501,171

[45] Date of Patent: Mar. 26, 1996

[54] FLEXIBLE BOOKMARK WITH HOLDER FOR WRITING INSTRUMENT

[76] Inventor: Linda S. Leake, 4407 Sunscape La., Raleigh, N.C. 27613

[21] Appl. No.: 344,370

[22] Filed: Nov. 23, 1994

[51] Int. Cl.[6] ..... B42D 9/00; A45C 11/00

[52] U.S. Cl. ..... 116/234; 281/42; 206/37

[58] Field of Search ..... 116/234–239; 281/28, 30, 31, 42, 51; 206/37, 38, 214, 224, 443; 383/7; D19/32, 34

[56] References Cited

U.S. PATENT DOCUMENTS

| | | | |
|---|---|---|---|
| D. 297,148 | 8/1988 | Freedman . | |
| D. 317,175 | 5/1991 | Dickson . | |
| D. 324,879 | 3/1992 | Morgan . | |
| D. 325,929 | 5/1992 | Larson et al. . | |
| 1,603,861 | 10/1926 | Mundis | 206/37 R |
| 1,802,081 | 4/1931 | Kelly . | |
| 1,974,667 | 9/1934 | Solinger . | |
| 2,344,613 | 3/1944 | Hellstern | 116/237 |
| 2,664,847 | 1/1954 | Orman | 116/239 |
| 3,068,840 | 12/1962 | Pullins | 206/214 |
| 3,898,951 | 8/1975 | Clare . | |
| 4,162,800 | 7/1979 | Gonot, Jr. et al. . | |
| 4,706,995 | 11/1987 | Dopp . | |
| 4,733,426 | 3/1988 | George | 15/244.3 |
| 4,984,529 | 1/1991 | Dickson . | |
| 5,016,559 | 5/1991 | Larson et al. . | |
| 5,095,846 | 3/1992 | Knight . | |
| 5,325,959 | 7/1994 | Goldberger | 281/42 |

FOREIGN PATENT DOCUMENTS

| | | | |
|---|---|---|---|
| 364796 | 1/1923 | Germany | 206/214 |

*Primary Examiner*—William A. Cuchlinski, Jr.
*Assistant Examiner*—Andrew Hirshfeld
*Attorney, Agent, or Firm*—Richard E. Jenkins

[57] ABSTRACT

A combination bookmark and holder for a writing instrument including an elongated, flexible bookmark strip having an upper portion and a lower portion. The upper portion is of sufficient length so as to fit between the pages of a book in the direction parallel to the spine of the book and the lower portion defines an elongated, flexible pouch therein parallel to the upper portion for releasably holding a writing instrument. In the preferred embodiment, the bookmark is formed from a knit stretch material such that it may be easily folded or compressed into a small bundle when the writing instrument is removed for easy storage on the person of the user.

5 Claims, 2 Drawing Sheets

FLEXIBLE BOOKMARK WITH HOLDER FOR WRITING INSTRUMENT

TECHNICAL FIELD

The present invention relates to an improved bookmark for use with a book or other printed publication to indicate the reader's place in the reading thereof. More particularly, the present invention relates to a flexible bookmark having an integral flexible pouch in the lower portion thereof for removably retaining a pen, pencil or felt marker or combinations thereof.

RELATED ART

Bookmarks including retaining means for a pen or the like are well known in the art. By way of example, see U.S. Pat. Nos. 5,095,846; 5,016,559 and 4,162,800 which broadly disclose combination bookmark and writing instrument holders. However, previous combination bookmark and writing instrument holders have suffered from a number of practical shortcomings and have not been well received in the marketplace.

By contrast, applicant has developed a combination bookmark and holder for a writing instrument such as a pen, pencil or felt marker or combinations thereof which is easy to carry, does not damage a book into which it is placed, is lightweight, practical and easy to use, and comprises a flexible pouch which will releasably hold a wide variety of different size writing instruments.

DISCLOSURE OF THE INVENTION

In accordance with the present invention, applicant provides a combination bookmark and holder for a writing instrument comprising an elongated, flexible bookmark strip having an upper and lower portion. The upper portion is of sufficient length so as to fit between the pages of substantially any size book in a direction parallel to the spine of the book, and the lower portion defines an elongated, flexible pouch therein parallel to the upper portion for releasably holding a writing instrument therein.

It is therefore an object of the present invention to provide a simple, attractive and highly functional combination bookmark and holder for a writing instrument which will gain wide acceptance in the marketplace.

Another object of the present invention is to provide a combination bookmark and holder for a writing instrument which prevents the user from losing his reading position in a publication while simultaneously allowing him ready access and use of the writing instrument without losing his aforementioned reading position.

Another object of the present invention is to provide a combination bookmark and holder for a writing instrument which has a pleasing aesthetic construction and yet can be easily folded or squeezed into a small configuration when the writing instrument is removed for storage on the person of the user.

Other objects, features and advantages of the invention will become apparent as the description thereof proceeds when considered in connection with the accompanying illustrative drawings described hereinbelow.

BEST MODE FOR CARRYING OUT THE INVENTION

Figure 1:
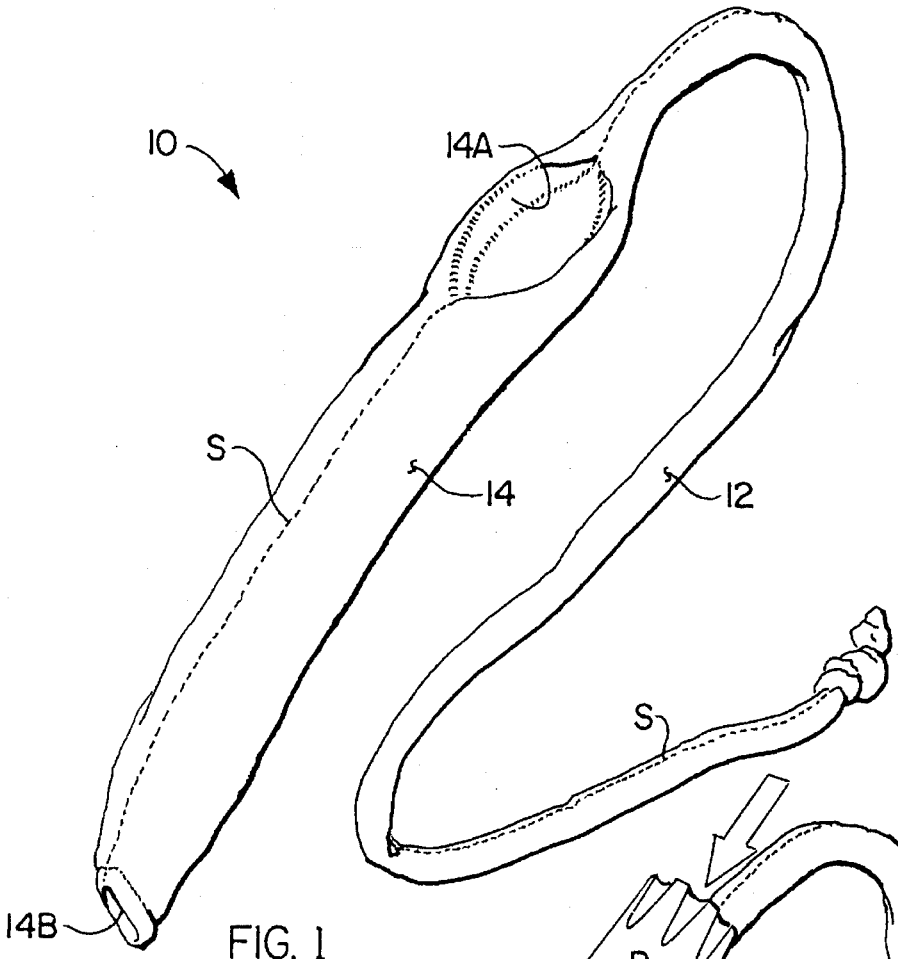
FIG. 1 is a perspective view showing a first embodiment of the bookmark of the present invention without a writing instrument positioned in the pouch thereof.
Figure 2:
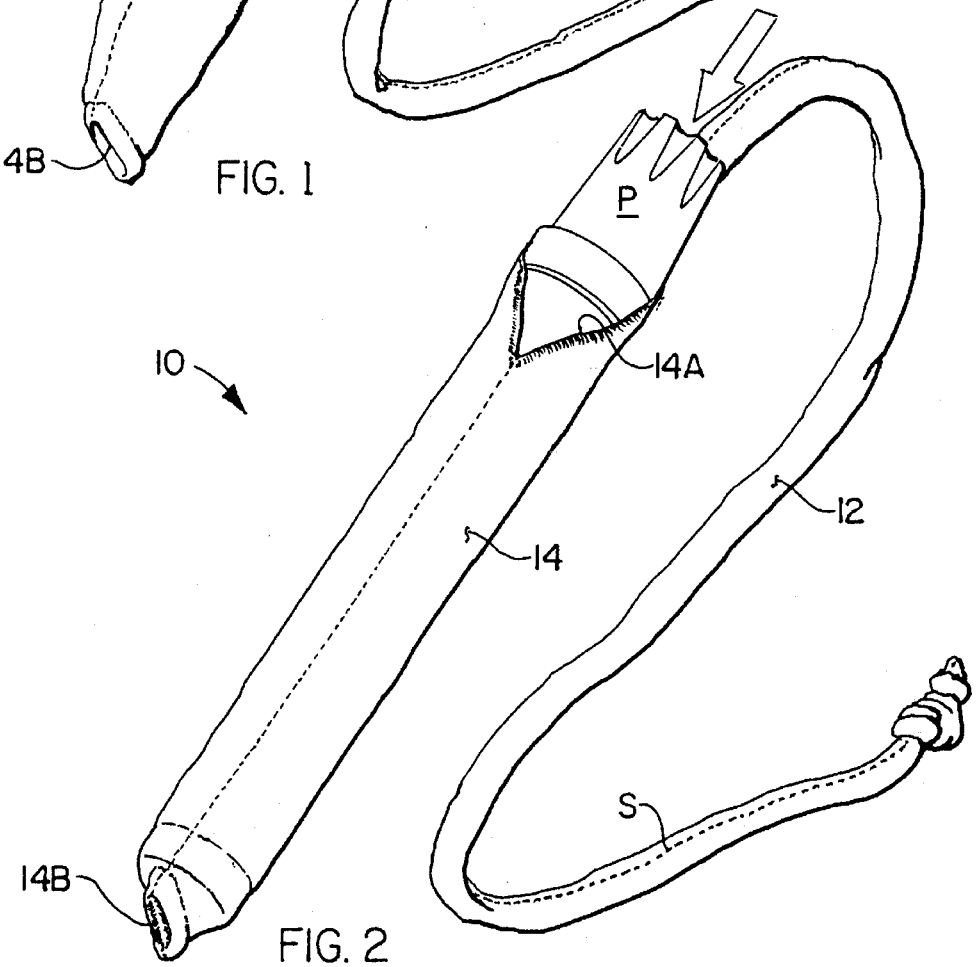
FIG. 2 is a perspective view of the bookmark of FIG. 1 with a writing instrument having been slidably positioned within the pouch thereof.

Referring now to the drawings, a bookmark 10 in accordance with the present invention is shown in FIGS. 1 and 2 and is generally designated 10. Bookmark 10 is formed from a flexible material, most suitably an elastic LYCRA knitted fabric, and includes elongated strip or marker portion 12 and elongated pouch portion 14 for receiving a writing instrument such as a pen, pencil, or felt-tip marker. Elongated pouch portion 14 is parallel to elongated strip or marker portion 12. As seen in FIGS. 1 and 2, the pouch portion 14 of bookmark 10 comprises an open end 14A at the juncture of the strip or marker portion 12 and pouch portion 14 and a closed end 14B at the other end thereof. Whereas FIG. 1 shows bookmark 10 in its empty mode, FIG. 2 shows bookmark 1O with a conventional felt-tip marker P having been slidably positioned therein. Thus, as shown in FIG. 2, the bookmark may be used to indicate a reader's place in a book or the like and simultaneously serve to contain a marking instrument such as a felt-tip highlighter for use as needed. In this fashion, bookmark 10 helps prevent the user from misplacing a writing instrument being used during reading of a publication in which bookmark 10 is periodically placed to indicate the stopping point at the last reading session. Significantly, pouch portion 14 of bookmark 10 is designed so as to hang over the outside spine of the book or the like and thereby prevent damage to the inside pages or spine of a publication being read.

Although bookmark 10 may be formed from a variety of materials such as textile fabrics, leather and rubber, applicant has discovered that a knit LYCRA material is particularly advantageous due to its high degree of flexibility and elasticity. Bookmark 10 is most suitably formed from a length of sheet-like material which has a first width along the length of elongated strip or marker portion 12 and a second wider width along the length of pouch portion 14. To form bookmark 10 from the aforementioned sheet-like material, the longitudinally extending edges of the sheet-like material are most suitably rolled over and stitched together with stitch S (see FIGS. 1–3) so as to form a tube having a first diameter along the length of strip or marker portion 12 and a second relatively larger diameter along the length of pouch portion 14. Open end 14A to pouch portion 14 is formed at the juncture between strip or marker portion 12 and pouch portion 14. Also, closed end 14B of pouch portion 14 is most suitably closed by being sewn together in a conventional manner.

Figure 3:
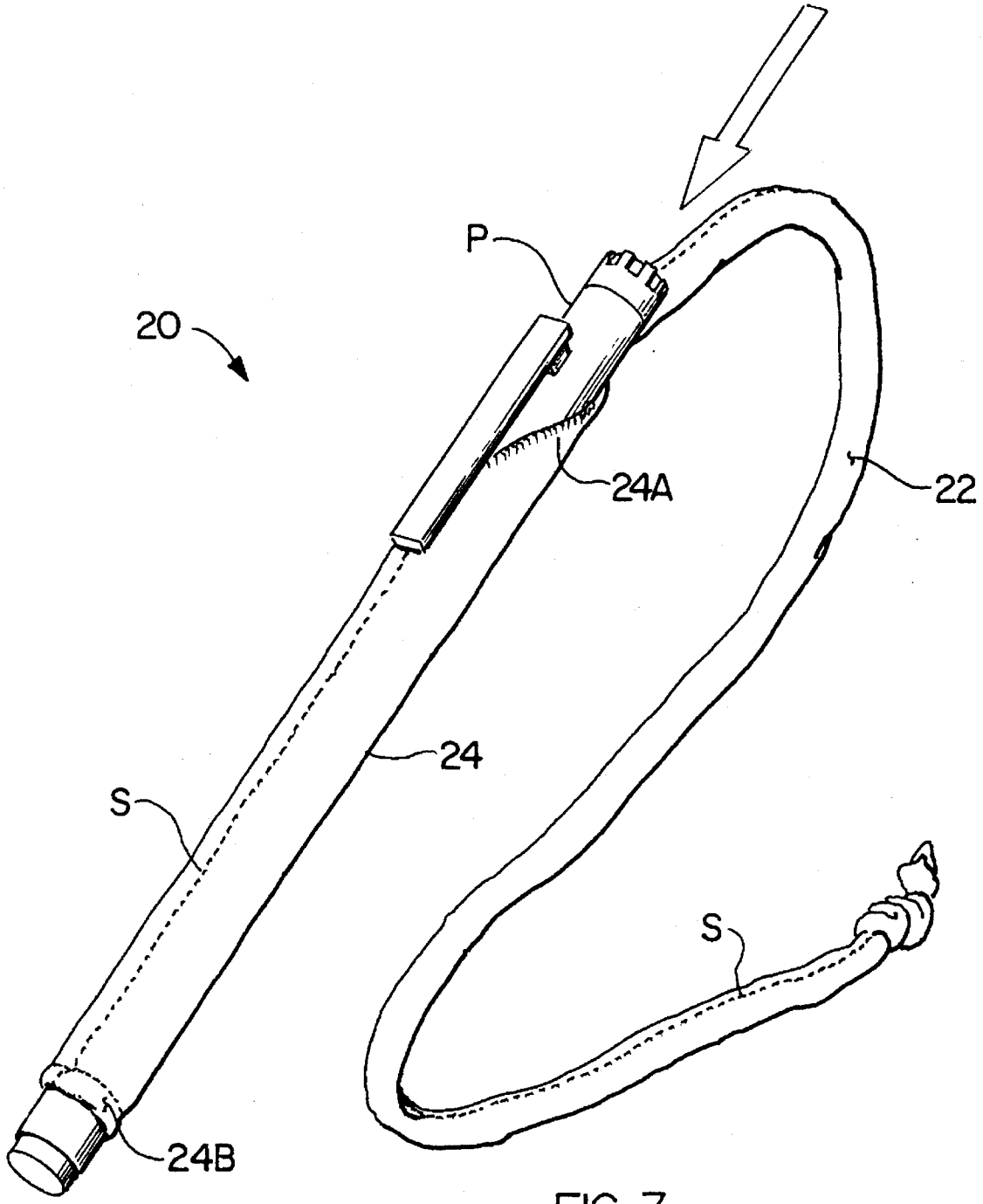
FIG. 3 is a perspective view of an alternative embodiment of the bookmark of the present invention wherein the pouch of the bookmark has an open end so that a writing instrument may be positioned therein and used without being removed from the bookmark.

A second embodiment of the bookmark is shown in FIG. 3 and generally designated 20. Bookmark 20 is similar to bookmark 10 and formed from elongated strip or marker portion 22 and pouch portion 24. However, pouch portion 24 includes an upper open end 24A at the juncture of strip or marker portion 12 and pouch portion 24 and an open lower end 24B. By providing an open lower end 24B, bookmark 20 provides the additional advantage that writing instrument P may be slidably positioned within pouch portion 24 with the writing end extending outwardly from open end 24B. Thus, the closure cap (not shown) may be removed from the writing end of writing instrument P, and writing instrument P may be used while it is still retained in pouch portion 24 of bookmark 20. This feature advantageously allows the user of bookmark 20 to use writing instrument P while reading a book or other publication without having to remove writing instrument P from bookmark 20. In other words, bookmark 20 and writing instrument P may both be periodically used without requiring removal of writing instrument P from the bookmark.

Also, applicant contemplates use of a writing instrument (not shown) having a pen at one end and a felt-tip marker at the other end with bookmark 20. This provides the flexibility of providing use of either end of the writing instrument (not shown) while the instrument remains in pouch portion 24 of bookmark 20.

As can be appreciated with reference to FIGS. 1–3 of the drawings and the detailed description set forth hereinabove, the bookmark of the invention lends itself to being folded or squeezed together into a very small volume when not in use so that it may be easily carried on the person of the user or placed in a small space in a pocketbook, wallet, or other personal container.

It will be understood that various details of the invention may be changed without departing from the scope of the invention. Furthermore, the foregoing description is for the purpose of illustration only, and not for the purpose of limitation—the invention being defined by the claims.

What is claimed is:

1. A combination bookmark and holder for a writing instrument comprising:

an elongated, elastic bookmark strip having an upper and a lower portion;

said upper portion being of sufficient length so as to fit between pages of an average book in a direction parallel to the spine of said book and said lower portion defining an elongated, flexible pouch therein for releasably holding the writing instrument therein; and wherein said elastic strip comprises a length of elastic sheet-like material having a first width along the length of said upper portion and a second, relatively wider width along the length of said lower portion, and wherein opposing longitudinally extending edges of said sheet-like material are rolled over and stitched together so as to form a tube having a first diameter along the length of said upper portion and having a second, relatively larger diameter along the length of said lower portion, said pouch being the tube at the lower portion of said elongated bookmark strip, and an opening to said pouch being defined at the juncture between said upper and lower portions of said elongated bookmark strip.

2. A combination bookmark and holder for a writing instrument comprising:

an elongated, flexible bookmark strip having an upper and a lower portion, wherein said flexible strip comprises a length of flexible sheet-like material having a first width along the length of said upper portion and a second, relatively wider width along the length of said lower portion, and wherein opposing longitudinally extending edges of said sheet-like material are rolled over and stitched together so as to form a tube having a first diameter along the length of said upper portion and having a second, relatively larger diameter along the length of said lower portion, and an opening to said tube being defined at the juncture between said upper and lower portions of said elongated bookmark strip;

said upper portion being of sufficient length so as to fit between pages of a book in a direction parallel to the spine of said book; and said tube at said lower portion defining an elongated, flexible pouch therein for releasably holding the writing instrument therein.

3. A combination bookmark and holder for a writing instrument comprising:

an elongated, elastic bookmark strip having an upper and a lower portion, wherein said elastic strip comprises knit fabric;

said upper portion being of sufficient length so as to fit between pages of an average book in a direction parallel to the spine of said book and said lower portion defining an elongated, flexible pouch therein for releasably holding the writing instrument therein; and wherein said elastic strip comprises a length of elastic sheet-like material having a first width along the length of said upper portion and a second, relatively wider width along the length of said lower portion, and wherein opposing longitudinally extending edges of said sheet-like material are rolled over and stitched together so as to form a tube having a first diameter along the length of said upper portion and having a second, relatively larger diameter along the length of said lower portion, said pouch being the tube at the lower portion of said elongated bookmark strip, and an opening to said pouch being defined at the juncture between said upper and lower portions of said elongated bookmark strip.

4. A combination bookmark and holder for a writing instrument comprising:

an elongated, elastic bookmark strip having an upper and a lower portion;

said upper portion being of sufficient length so as to fit between pages of an average book in a direction parallel to the spine of said book and said lower portion defining an elongated, flexible pouch therein for releasably holding the writing instrument therein, wherein said elongated pouch defines a proximal end adjacent said upper portion for receiving the writing instrument and a closed distal end; and wherein said elastic strip comprises a length of elastic sheet-like material having a first width along the length of said upper portion and a second, relatively wider width along the length of said lower portion, and wherein opposing longitudinally extending edges of said sheet-like material are rolled over and stitched together so as to form a tube having a first diameter along the length of said upper portion and having a second, relatively larger diameter along the length of said lower portion, said pouch being the tube at the lower portion of said elongated bookmark strip, and an opening to said pouch being defined at said proximal end.

5. A combination bookmark and holder for a writing instrument comprising:

an elongated, elastic bookmark strip having an upper and a lower portion;

said upper portion being of sufficient length so as to fit between pages of an average book in a direction parallel to the spine of said book and said lower portion defining an elongated, flexible pouch therein for releasably holding the writing instrument therein, wherein said elongated pouch defines a proximal end adjacent said upper portion for receiving the writing instrument and an open distal end; and wherein said elastic strip comprises a length of elastic sheet-like material having a first width along the length of said upper portion and a second, relatively wider width along the length of said lower portion, and wherein opposing longitudinally extending edges of said sheet-like material are rolled over and stitched together so as to form a tube having a first diameter along the length of said upper portion and having a second, relatively larger diameter along the length of said lower portion, said pouch being the tube at the lower portion of said elongated bookmark strip, and an opening to said pouch being defined at said proximal end.

* * * * *